US011370461B2

(12) United States Patent
Erharter et al.

(10) Patent No.: US 11,370,461 B2
(45) Date of Patent: Jun. 28, 2022

(54) STATION OF A CABLE TRANSPORTATION SYSTEM

(71) Applicant: LEITNER S.P.A., Vipiteno (IT)

(72) Inventors: Nikolaus Erharter, San Candido (IT); Roberto Boito, Pineta di Laives (IT)

(73) Assignee: LEITNER S.P.A., Vipiteno (IT)

( * ) Notice: Subject to any disclaimer, the term of this patent is extended or adjusted under 35 U.S.C. 154(b) by 340 days.

(21) Appl. No.: 16/474,468

(22) PCT Filed: Jan. 5, 2018

(86) PCT No.: PCT/IB2018/050085
§ 371 (c)(1),
(2) Date: Jun. 27, 2019

(87) PCT Pub. No.: WO2018/127841
PCT Pub. Date: Jul. 12, 2018

(65) Prior Publication Data

US 2019/0344807 A1 Nov. 14, 2019

(30) Foreign Application Priority Data

Jan. 5, 2017 (IT) ..... 102017000001070

(51) Int. Cl.
*B61B 1/02* (2006.01)
*B61B 12/02* (2006.01)

(52) U.S. Cl.
CPC ..... *B61B 1/02* (2013.01); *B61B 12/02* (2013.01); *B61B 12/022* (2013.01)

(58) Field of Classification Search
CPC ..... B61B 12/022; B61B 1/02; B61B 12/02; B61B 1/00; B61B 3/00; B61B 12/024; B61B 12/026; A63G 1/00
(Continued)

(56) References Cited

U.S. PATENT DOCUMENTS 4,760,798 A * 8/1988 Blengini ..... B61B 12/122 104/209
10,286,926 B2 * 5/2019 Blengini ..... B61B 12/10
(Continued)

FOREIGN PATENT DOCUMENTS

DE 2060030 6/1972
EP 1176077 1/2002
(Continued)

OTHER PUBLICATIONS

Notification Concerning Submission, Obtention or Transmittal of Priority Document for International Application No. PCT/IB2018/050085 dated Mar. 26, 2018.
International Search Report and Written Opinion for International Application No. PCT/IB2018/050085 dated May 7, 2018.
Amendments to the Claims under PCT Article 19 for International Application No. PCT/IB2018/050085 dated Jul. 5, 2018.
(Continued)

*Primary Examiner* — S. Joseph Morano
*Assistant Examiner* — Cheng Lin
(74) *Attorney, Agent, or Firm* — Neal, Gerber & Eisenberg LLP

(57) ABSTRACT

A station of a cable transportation system configured for U-turning the direction of movement of a transportation unit supported and moved outside the station by at least a cable. The station includes a device for the automatic uncoupling of the cable from the transportation unit; and a device for the automatic coupling of the cable to the transportation unit. The station also includes a guiding device extending along a longitudinal axis and configured for supporting and guiding the transportation unit inside the station between the automatic uncoupling device and the automatic coupling device.

8 Claims, 6 Drawing Sheets

(58) Field of Classification Search
USPC ..... 104/112, 113, 115, 116, 91
See application file for complete search history.

(56) References Cited

U.S. PATENT DOCUMENTS

| | | | | |
|---|---|---|---|---|
| 2002/0007759 | A1* | 1/2002 | Meindl | B61B 7/04 104/89 |
| 2007/0250244 | A1* | 10/2007 | Revenant | B61B 12/105 701/96 |
| 2009/0107357 | A1 | 4/2009 | Richard | |
| 2009/0260949 | A1* | 10/2009 | Huber | B65G 17/086 198/324 |

FOREIGN PATENT DOCUMENTS

| | | |
|---|---|---|
| EP | 2157004 | 2/2010 |
| EP | 2623388 | 8/2013 |
| FR | 2504480 | 10/1982 |
| WO | WO 2015/166357 | 11/2015 |

OTHER PUBLICATIONS

PCT Demand for International Preliminary Examination and Reply to International Search Report and the associated Written Opinion for International Application No. PCT/IB2018/050085 dated Oct. 24, 2018.

Notification of Receipt of Demand by Competent International Preliminary Examining Authority (Form PCT/IPEA/402) for International Application No. PCT/IB2018/050085 dated Nov. 5, 2018.

Second Written Opinion of the International Preliminary Examining Authority for International Application No. PCT/IB2018/050085 dated Dec. 14, 2018.

Reply to the Second Written Opinion of the International Searching Authority for International Application No. PCT/IB2018/050085 dated Jan. 28, 2019.

Notification of Transmittal of the International Preliminary Report on Patentability (Form PCT/IPEA/416) for International Application No. International Application No. PCT/IB2018/050085 dated Mar. 25, 2019.

* cited by examiner 9
28
2
19
3
27
12
D
10
13
3
16
20
20
15
3
18
20
1
17
3
3
11
14
8
7
7

I
3
O
5
29
4
31
d
4
30
6

STATION OF A CABLE TRANSPORTATION SYSTEM

PRIORITY CLAIM

This application is a national stage application of PCT/IB2018/050085, filed on Jan. 5, 2018, which claims the benefit of and priority to Italian Patent Application No. 102017000001070, filed on Jan. 5, 2017, the entire contents of which are each incorporated by reference herein.

TECHNICAL FIELD

The present disclosure relates to a station of a cable transportation system.

In particular, the present disclosure relates to an upstream or downstream station of a cable transportation system for the loading and unloading of passengers or material transported outside the station by a transportation unit, of a chairlift or a cable car type or similar, supported and hauled by at least one cable.

Even more particularly, the station of the present disclosure is provided, at the inlet and at the outlet, with devices for the automatic coupling and uncoupling of the cable and the station is configured so that, inside, the transportation unit can U-turn the direction of movement with a moving speed, which is lower than the cruising speed between the stations without having to slow down all of the remaining transportation units outside the station.

BACKGROUND

In one kind of station, the provision of a guiding device is known, configured for supporting the transiting transportation unit when it is uncoupled from the cable and for guiding it from the entrance to the exit of the station. Such guiding device is usually in the form of at least a rail placed at the top of the transportation unit, which extends along a longitudinal axis of the station and then makes a U-turn and continues in the opposite direction until the exit of the station where it terminates in correspondence with a device for automatic coupling to the cable. After passing the automatic coupling device, the transportation unit is coupled to the cable and proceeds towards the following station of the system.

The development of the guiding device inside the station, as defined previously, in other words configured for U-turning the transportation unit, can be subdivided into a series of portions. In particular:

- an inlet portion in the station delimited upstream by the automatic uncoupling device and in which the transportation unit is decelerated until such a speed as to allow the relatively safe unloading and loading;
- an unloading/loading portion following the inlet portion, in which the unloading and loading takes place and the transportation unit proceeds at a substantially constant low speed along the guide;
- an outlet portion from the station following the unloading/loading portion delimited downstream by the device for the automatic coupling to the cable and in which the transportation unit is accelerated until such a speed as to allow the relatively safe coupling to the cable.

In even greater detail, the unloading/loading portion can be subdivided into an unloading portion on the one side and an unloading portion on the other side with respect to the longitudinal axis of the station.

Naturally, the loading of passengers may also take place in the portion defined as for unloading, and the unloading of passengers may take place in the portion defined as for loading. Furthermore, the terms indicated "upstream" and "downstream" refer to the advancing direction of the transportation unit in the station.

As is known, the inlet portion of the guide is defined as the portion in which the transportation unit is slowed down with respect to the traveling speed between the stations so as to reach a low speed to allow the relatively safe loading and unloading of passengers. The inlet portion terminates in correspondence with the start of the area for accessing the transportation units. On the contrary, the outlet portion of the guide is defined as the portion in which the transportation unit is accelerated so as to reach such a relatively high speed as to allow the correct coupling to the cable. In such outlet portion it is no longer possible to access the transportation unit. In the loading/unloading portion, the transportation unit continues its path at a substantially constant speed along the guiding device without stopping other than for particular needs. The low loading/unloading speed may also be subject to variations or also include stopping pauses.

The loading/unloading portion of the guiding device comprises rectilinear portions parallel to the axis of the station, connected respectively to the inlet and outlet portion, and curvilinear portions, which are connected to each other in the point of maximum extension of the guiding device in the station.

As said previously, the transportation unit is moved at a lower speed in the loading/unloading portion than along the rest of the path, to allow the relatively comfortable loading and unloading of passengers. However, the advancing speed of the transportation units in this portion cannot be reduced at will, and presents a lower limit depending on the frequency of the transportation units and the minimum distance, which must be present between such units in the curved portions of the station. That is, if the cabins were made to advance at too low a speed they might knock together in correspondence with the curved portions of the guiding portions, as well as along the rectilinear portions in the case of further slowing down.

SUMMARY

It is the object of the present disclosure to produce an alternative station of a cable transportation system in which the loading and unloading of passengers is carried out relatively safely and comfortably.

According to such object, the present disclosure relates to a station of a cable transportation system configured for U-turning the direction of movement of a transportation unit supported and moved outside the station by at least a cable. In particular, according to the present disclosure, the station comprises:

- a device configured to automatically uncouple the cable from the transportation unit;
- a device configured to automatically couple the cable to the transportation unit;
- a guiding device, extending along a longitudinal axis and configured for supporting and guiding the transportation unit inside the station between the automatic uncoupling device and the automatic coupling device.

In general, the longitudinal axis identifies the axis along which the station identifies the U-plan path of the transportation units and can be defined, for example, as the axis passing through a point of medium distance between the automatic uncoupling device and the automatic coupling device and the point of maximum depth of the guiding device in the station.

Both the automatic uncoupling/coupling devices and the guiding device are structurally achievable according to the prior art while the definition of station configured "for the U-turn" aims to differentiate the disclosure from the so-called "back-and-forth" stations and from those in which the loading and unloading take place along rectilinear portions substantially orthogonal to the axis of the station.

According to the general aspect of the disclosure, the guiding device identifies a plan path inside the station comprising at least one laterally enlarged portion, which is more distant from the longitudinal axis than the device for the automatic uncoupling and/or the device for the automatic coupling. In particular, in such laterally enlarged portion, with respect to the longitudinal axis, the guiding device presents a plurality of points having a distance D greater than the distance d, which separates the same longitudinal axis from the inlet or outlet points of the station where the automatic uncoupling or coupling devices are located. The distance d is such as to simultaneously enable the access and exit of transportation units with respect to the station. In other words, according to the present disclosure, the guide comprises at least a plan portion situated outside an axis passing through the inlet or outlet point and parallel to the longitudinal axis of the station. Advantageously, in this way, the path in the station and, consequently, the passage time of the transportation unit in the station is increased, making the loading and unloading relatively longer and more comfortable.

In particular, the plan path of the guiding device comprises the following sequence of portions:

- an inlet portion delimited upstream by the automatic uncoupling device;
- an unloading/loading portion following the inlet portion;
- an outlet portion following the unloading/loading portion and delimited downstream by the automatic coupling device.

The boundaries of the unloading/loading portion can be defined in different functional and structural ways. According to a first definition, the boundaries of the unloading/loading portion are, on one side the starting point for accessing the transportation unit, placed downstream of the inlet portion and, on the other, the ending point for accessing the transportation unit, placed upstream of the outlet portion. If the transportation unit is a cable car, the starting and ending points for accessing the transportation unit coincide with the start of the procedures for opening the doors of the cable car and the end of the procedures for closing the same on completion of loading and unloading. In this sense, a platform or floor structure is included, in correspondence with the loading/unloading portion, for the transit and waiting of passengers.

Alternatively, the starting and ending points of the loading/unloading portion can be defined according to the position of the opening and dosing sensors of the doors of the cable cars, which operate with the passage of the cable cars themselves.

Alternatively again, the loading/unloading portion can be seen as the portion of the guiding device in which the transportation unit travels at a constant speed after an initial slowing down in the inlet portion and before the subsequent acceleration in the outlet portion.

According to certain embodiments of the disclosure, the laterally enlarged portion of the guiding device extends for at least a portion of the unloading/loading portion, as defined previously. Advantageously, in this way, the radius of curvature of the station-turn is extended, with the consequent possibility of further reducing the speed of the transportation unit in this curvilinear portion without the risk of collisions and making the loading and unloading time longer.

In particular, according to one embodiment of the disclosure, the enlarged portion continues from the unloading/loading portion respectively for at least a portion of the inlet portion and/or outlet portion of the guiding device. Advantageously, in this way, the transportation unit "anticipates" its lateral deviation in the deceleration portion and/or "delays" it in the acceleration portion, thus optimizing the relationship between the loading/unloading time and the total passage time in the station.

According to a first embodiment of the disclosure described above, the enlarged portion extends for the whole of the inlet portion and/or the outlet portion and is rectilinear. Advantageously, in this way, the braking of the transportation unit is achieved during rectilinear advancing, with consequent increased constructional simplicity.

According to a second embodiment of the disclosure described above, the enlarged portion of the inlet portion and/or outlet portion is curvilinear and follows a first inlet or outlet portion, which is rectilinear and parallel to the longitudinal axis of the station. Furthermore, in such embodiment, the unloading/loading portion comprises at least a rectilinear portion connected to the enlarged curved portion of the inlet portion and/or outlet portion. Advantageously, in this last embodiment the relationship between the loading/unloading time and the total passage time in the station is further optimized, comprising the braking or accelerating of the transportation unit, also in laterally deviated curved portions.

Naturally, the present disclosure refers both to symmetrical stations with respect to the axis of the station, and stations in which the guiding device presents an external lateral deviation only on one side with respect to the axis of the station. In this respect, the loading/unloading portion can be subdivided into a loading portion on one side and an unloading portion on the other side with respect to the longitudinal axis of the station. In a-symmetrical embodiments, only one from among the aforesaid loading and unloading portions presents an enlarged portion, which may also continue in the corresponding inlet or outlet portion.

Finally, the present disclosure also refers to a cable transportation system comprising at least a station as described previously.

Additional features are described in, and will be apparent from the following Detailed Description and the figures.

BRIEF DESCRIPTION OF THE DRAWINGS

Further characteristics and advantages of the present disclosure will become apparent from the following description of one of its non-limiting embodiment with reference to the figures of the appended drawings, wherein.

DETAILED DESCRIPTION

The present disclosure refers to a station of a cable transportation system configured for U-turning the direction of movement of transportation units supplied one after another. The cable transportation system thus comprises a plurality of transportation units, which are supported and hauled by at least a cable along a path limited by stations in correspondence with which the unloading and loading of passengers or material may take place.

Figure 1:
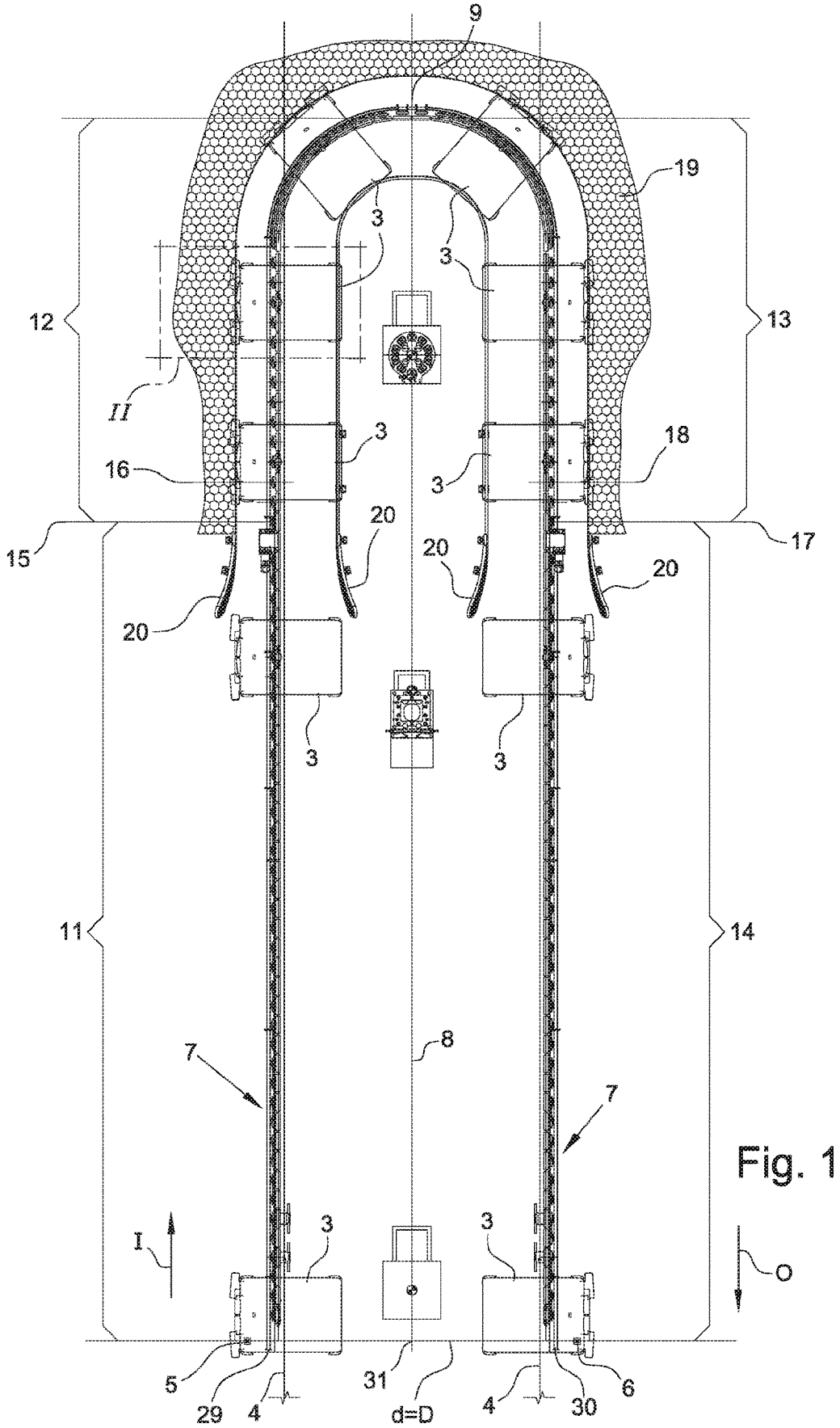
FIG. 1 is a plan view of a station configured for U-turning the transportation unit according to the prior art.

FIG. 1 shows a plan view of an example station, according to the prior art, that is configured for U-turning the direction of movement of a plurality of transportation units.

According to such example of the prior art, the station comprises an inlet provided with an automatic uncoupling device 5 of the cable 4 from the advancing transportation units 3. In correspondence with the automatic uncoupling device 5, the station in FIG. 1 comprises an inlet or starting point 29 of a guiding device 7 configured to support and guide the transportation unit 3 inside the station when the transportation unit is disconnected from the cable 4. Such guiding device 7 will be described in further detail in the description in FIGS. 2 and 3. Complementarily, the guiding device 7 comprises an outlet or end point 30 in correspondence with which a device is provided for the automatic coupling 6 of the cable 4 to the advancing transportation units 3.

As can be seen in FIG. 1, the station has a plan development along a longitudinal axis 8, which, for example, can be defined as the axis passing between the midpoint 31 between the inlet 29 and outlet 30 point of the guiding device 7 and the point of maximum extension 9 of the guide 7 in the station. With reference to such axis 8, the plan path of the guiding device 7 can be subdivided into a plurality of consecutive portions between the inlet point 29 and the outlet point 30. In particular, the guide 7 in FIG. 1 of the prior art comprises an inlet portion 11 delimited upstream by an inlet point 29. The boundary downstream of the inlet portion 11 can consist of the starting point for access to the transportation unit, where, in certain embodiments, a command sensor 15 is positioned for opening the doors of the cabins 3. The cabin 3 is slowed down along the inlet portion 11 to reach a relatively low speed for the relative safe loading and unloading, which takes place with the cabin moving. According to this known station, in plan, the inlet portion 11 is rectilinear and parallel to the axis 8.

The following portion of the guiding device can be defined as an unloading portion 12, which starts immediately downstream of the command sensor 15 for opening the doors of the cabin 3 and terminates in correspondence with the point of maximum extension 9 where it connects to the following portion. Such unloading portion 12 comprises a first portion, which is rectilinear and parallel to the axis 8 connected to the inlet portion 11 at the start of which the opening of the cabin doors is completed. The point of complete opening is outlined in FIG. 1 with reference 16 slightly downstream with respect to the sensor 15. The unloading portion 12 also comprises a following curved portion, substantially a fourth of the circumference, which makes a connection with the following loading portion 13. Along the unloading portion 12 the cabin 3 advances at a substantially constant speed along the guide 7.

Specularly with respect to the axis 8, the loading portion 13 comprises a curved portion, which connects to a portion that is rectilinear and parallel to the axis 8 and terminates in correspondence with the point of complete closure 17 of the doors of the cabin 3. Immediately upstream of the point of complete closure 17 of the doors in FIG. 1 a sensor is outlined with reference 18, which commands the start of the procedure for closing the doors of the cabins 3. A platform 19 is present, in correspondence with the unloading portion 12 and the loading portion 13, for assisting with the unloading/loading of the passengers, and two borders 20, which work with the lower portion of the cabin 3 to limit its lateral movements.

The path of the cabin 3 in the station continues along an outlet portion 14, which terminates at the outlet of the station in correspondence with the outlet point 30, where the automatic coupling device 6 is provided, beyond which the cabin 3 is supported and drawn by the cable 4. Along this outlet portion 14 the cabin 3 is accelerated so as to be coupled, or connected, to the cable without jerking.

As can be seen in FIG. 1, this station, according to the prior art, comprises a guiding device 7, which does not present plan portions, which are distanced from the longitudinal axis 8 for a distance greater than that present at the inlet 29 or outlet 30 point, where the automatic coupling 6 and uncoupling 5 devices are located. The direction from upstream to downstream is defined following the movement of the transportation units 3 in the station indicated in FIGS. 1 and 4-7 with the arrow I in inlet and with the arrow O in outlet.

Figure 2:
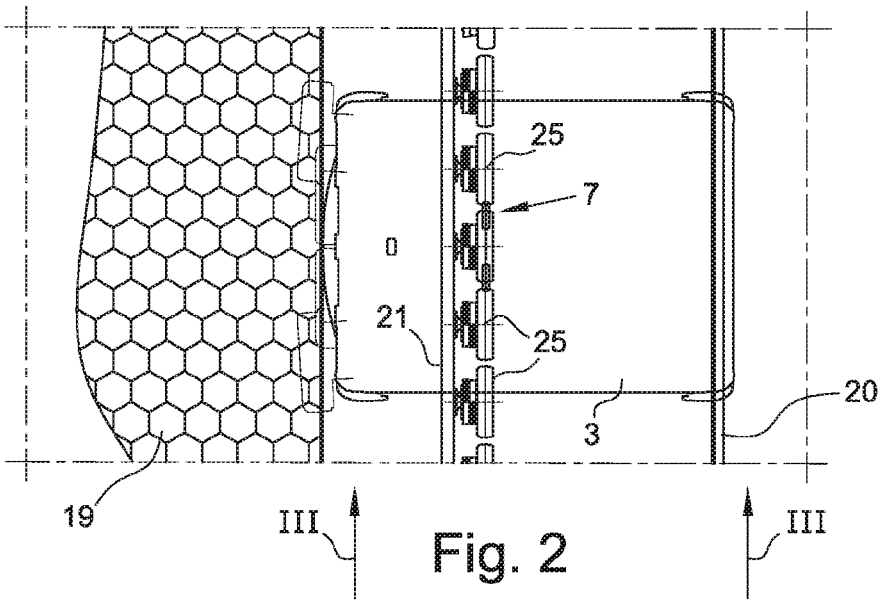
FIG. 2 is an enlarged view of a detail in FIG. 1 indicated with II, showing an example of the guiding device, which supports the transportation unit in the station when the transportation unit is uncoupled from the cable.
Figure 3:
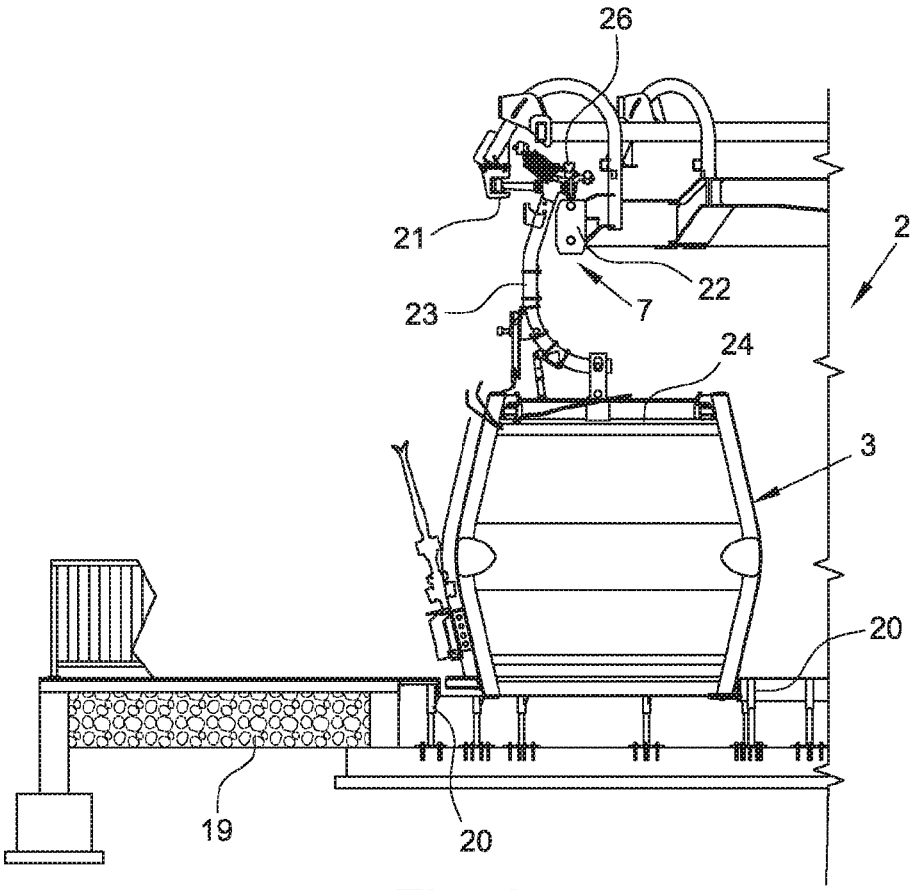
FIG. 3 is a raised view of the detail in FIG. 2 along the lines III-III showing how the transportation unit is supported by the guiding device during movement into the station.

FIGS. 2 and 3 show enlarged raised and plan views of the detail in FIG. 1 indicated with II. In particular, FIGS. 2 and 3 show an example of an embodiment of a guiding device 7 comprising a pair of rails 21, 22, which support respective roller portions of a suspension arm 23 connected to the roof 24 of the cabin 3. The advancing, acceleration and deceleration of the transportation unit along such tracks 21, 22 are imposed by a plurality of motorized wheels 25, such as made of rubber, which act against a corresponding portion 26, such as knurled, at the top of the suspension arm 23.

Figure 4:
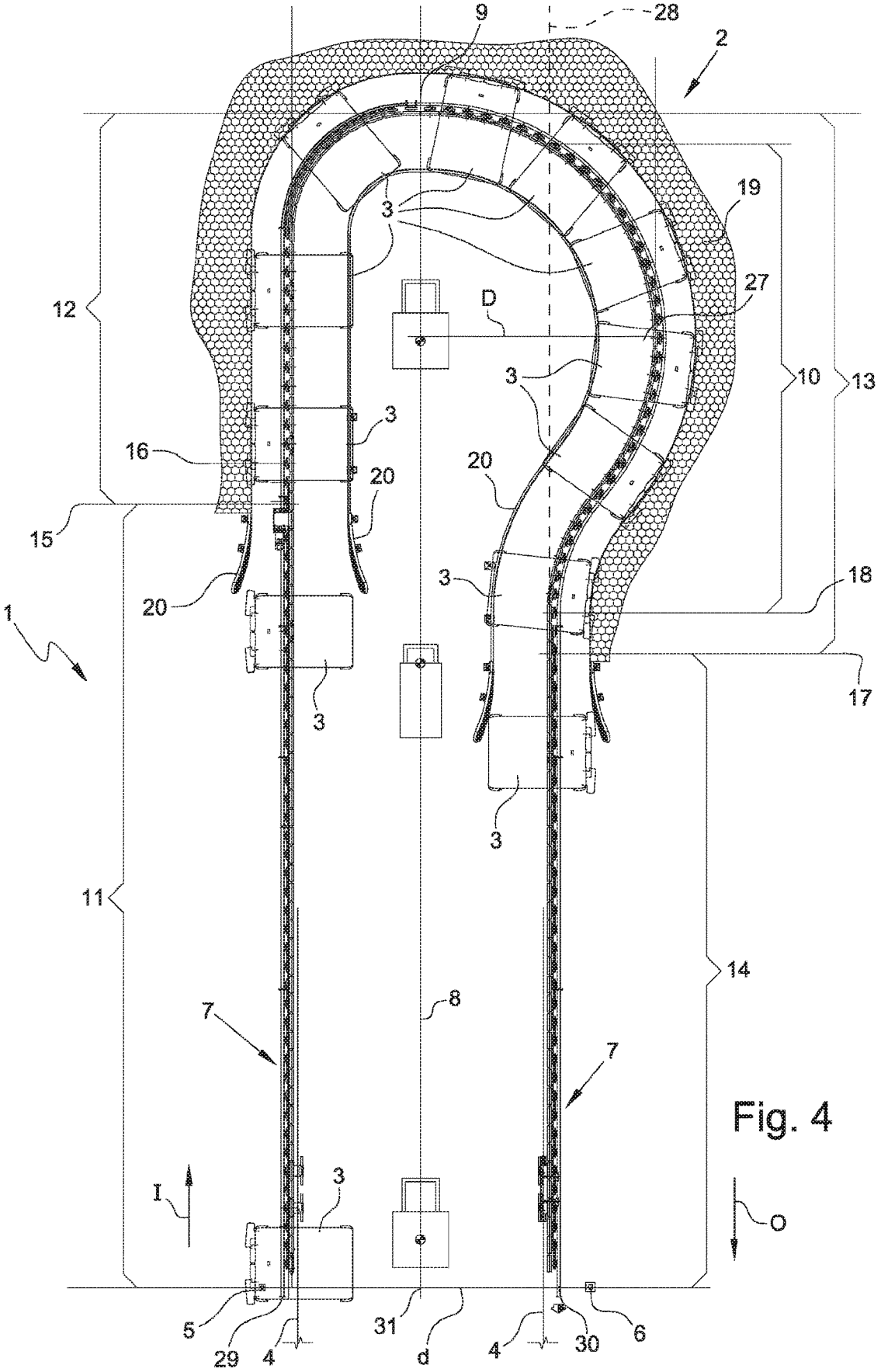
FIGS. 4-7 show four different embodiments of the disclosure wherein, in particular, FIG. 7 maximizes the relationship between the loading/unloading time and the total passage time of the transportation unit in the station.

FIG. 4 shows a plan view of a first embodiment of a station 2 according to the present disclosure. According to FIG. 4, the inlet portion 11, the unloading portion 12 and the outlet portion 14 of the guiding device 7 are realized according to the prior art described previously and visible in FIG. 1. In this embodiment the loading portion 13 is substantially internally curved and presents a plan portion 10, which is more distant from the longitudinal axis 8 than the distance present between the axis 8 and the outlet point 30, where the automatic coupling device 6 is arranged. In such embodiment, the point 27 of maximum lateral displacement 27, or maximum distance D from the axis 8, is substantially in the middle of the loading portion 13 when projected onto the axis 8.

To facilitate the identification of the laterally enlarged portion 10, a further axis 28 is shown in FIG. 4 parallel to the longitudinal axis 8, passing through the outlet point 30 of the outlet portion 14.

Figure 5:
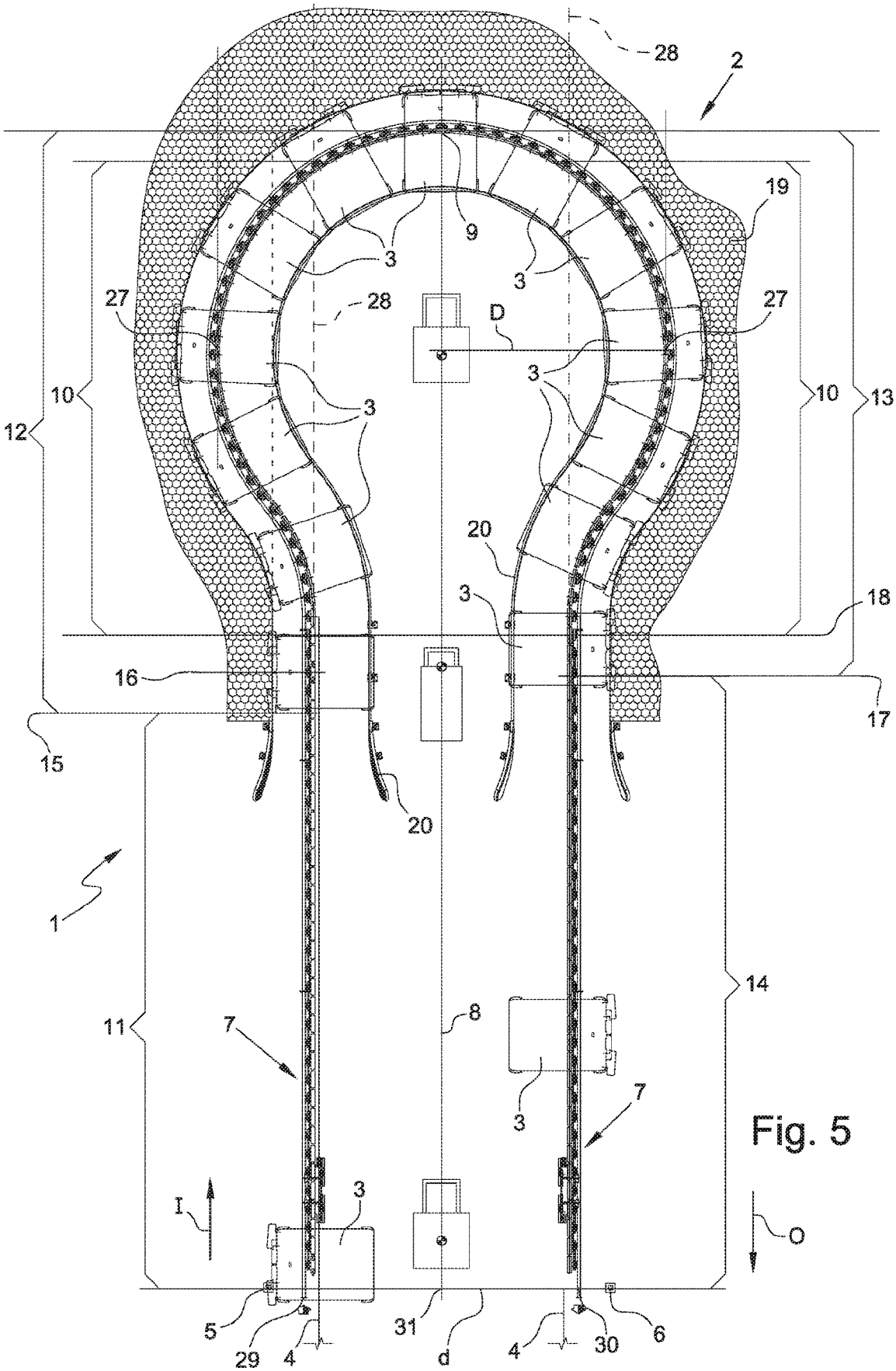

FIG. 5 shows a second example of an embodiment of a station according to the disclosure. In particular, FIG. 5 shows a plan view of a station 2 in which the loading portion 13 and the outlet portion 14 of the guiding device 7 are equal to the respective portions of the embodiment in FIG. 4. According to such embodiment in FIG. 5, the unloading portion 12 and the inlet portion 11 are symmetrical to the loading portion 13 and to the outlet portion 14 with respect to the longitudinal axis 8. Thus, in FIG. 5, the unloading portion 12 of the guiding device 7 also comprises a portion 10, which is more distant from the longitudinal axis 8 than the distance present between the axis 8 and the inlet point 29 of the inlet portion 11 where the automatic uncoupling device 5 is located.

Figure 6:
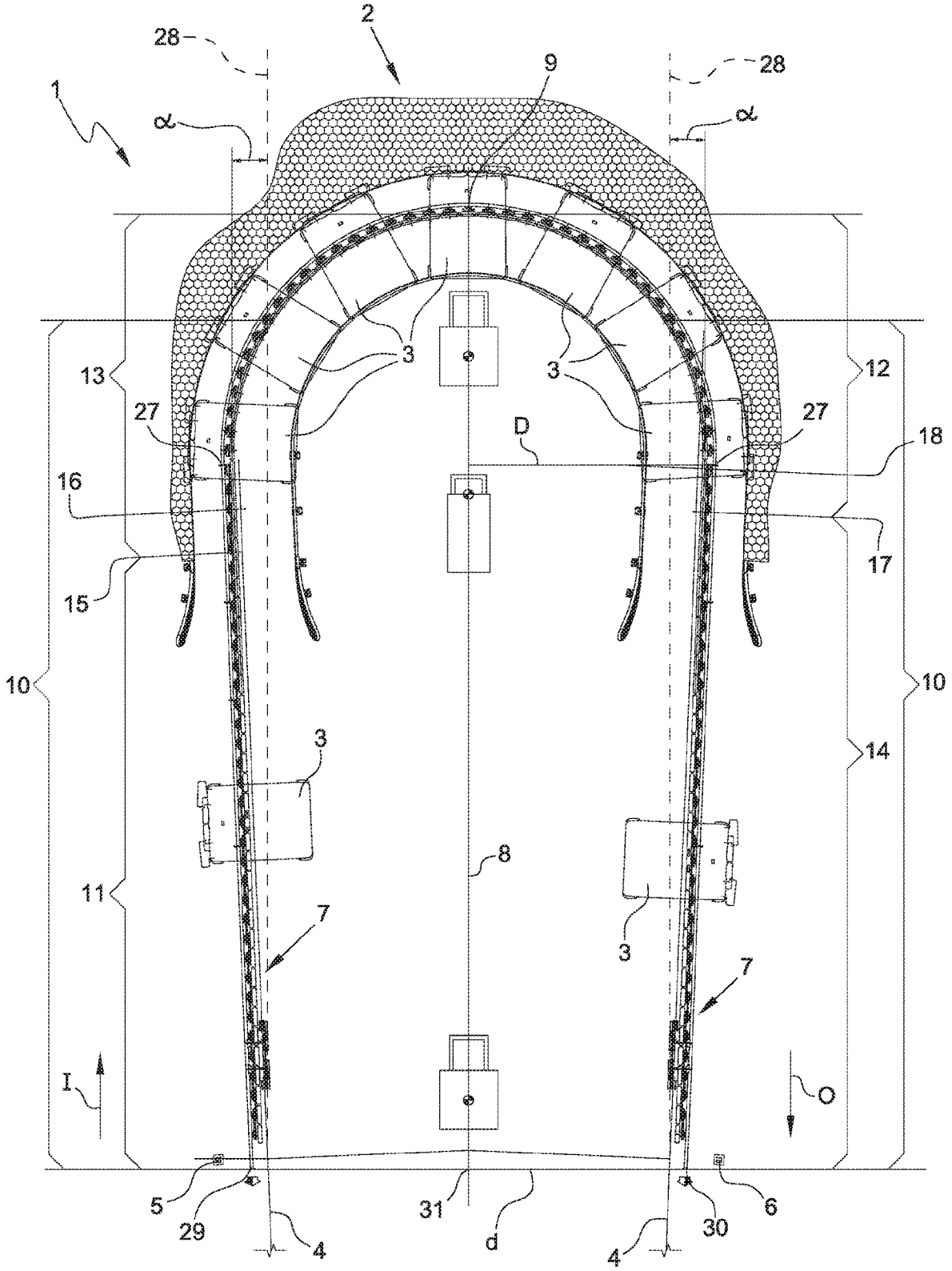

FIG. 6 shows a third embodiment of the disclosure. In such an embodiment, the inlet portion 11 and the outlet portion 14 are rectilinear but not parallel with respect to the longitudinal axis 8. In particular, the inlet portion 11 and the outlet portion 14 present an inclination α with respect to the longitudinal axis 8, which is such that they gradually distance themselves from the axis 8 starting from the inlet 29 and outlet 30 points. The unloading portion 12 and the loading portion 13 comprise inclined rectilinear portions joined respectively to the inlet portion 11 and to the outlet portion 14, and curved portions connected to one another. According to the embodiment in FIG. 6, the laterally enlarged portion 10 of the guiding device 17 extends for the whole length of the inlet portion 11 and the outlet portion 14 and for a part of the unloading portion 12 and the loading portion 13. In particular, the enlarged portion 10 comprises the whole length of the rectilinear portions and only part of the curved portions of the unloading portion 12 and the loading portion 13. According to such embodiment, the point 27 of maximum lateral displacement D of the portions 10 is in the middle of the unloading portion 12 and the loading portion 13 adjacent respectively to the inlet portion 11 and the outlet portion 14.

Figure 7:
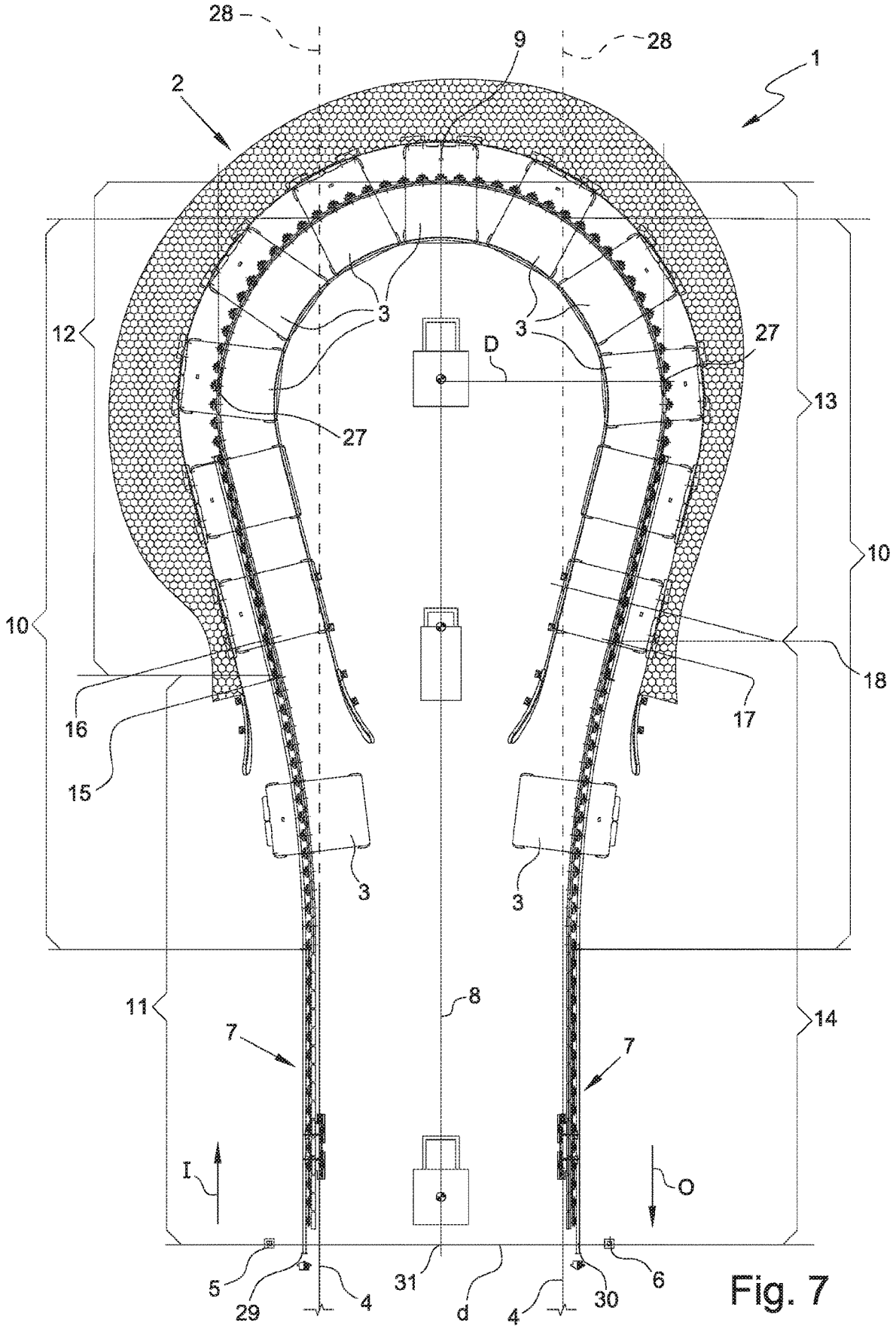

FIG. 7 shows a fourth embodiment of a station according to the disclosure. In particular, FIG. 4 shows a plan view of a station 2 in which all of the portions 11, 12, 13 14 of the guiding device 7 comprise both rectilinear portions and curvilinear portions. According to such FIG. 7, the inlet portion 11 comprises a portion, which is rectilinear and parallel to the longitudinal axis 8 starting from the inlet point 29 and a following curved portion, which terminates in correspondence with the start of the unloading portion 12. Such curved portion presents a curvature, which is such as to gradually distance itself from the longitudinal axis 8. The unloading portion 12 starts with a rectilinear portion connected to the curved portion of the inlet portion 11 and continues with a curved portion, which connects to the loading portion 13. As can be seen, the loading portion 13 and the outlet portion 14 are symmetrical to the unloading portion 12 and to the inlet portion 11 with respect to the longitudinal axis 8. In such embodiment, the point of maximum lateral displacement 27, or maximum distance D, is in the second half of the portion 10 projected onto the axis 8 close to the connection point between the unloading portion 12 and the loading portion 13.

Finally, it is evident that modifications and variations can be made to the disclosure described herein without departing from the spirit and scope of the appended claims. As such, the present disclosure also covers embodiments not described in the detailed description and equivalent embodiments that fall within scope of the appended claims. Accordingly, various changes and modifications to the presently disclosed embodiments will be apparent to those skilled in the art.

The invention claimed is:

1. A cable transportation system station for U-turning a direction of movement of a transportation unit supported and moved outside the cable transportation system station by a cable, the cable transportation system station comprising:

an automatic uncoupling device configured to automatically uncouple the cable from the transportation unit;

an automatic coupling device configured to automatically couple the cable to the transportation unit; and a guiding device extending along a longitudinal axis that passes through a first point of medium distance between the automatic uncoupling device and the automatic coupling device and a second point of maximum depth of the guiding device in the cable transportation system station, wherein:

the guiding device is configured to support and guide the transportation unit inside the cable transportation system station between the automatic uncoupling device and the automatic coupling device, a first distance between the longitudinal axis and the automatic uncoupling device and a second distance between the longitudinal axis and the automatic coupling device simultaneously enable an access to and an exit from the cable transportation system station, and the guiding device extends along a plan path comprising at least a laterally enlarged portion which is more distant from the longitudinal axis than at least one of the first distance between the longitudinal axis and the automatic uncoupling device and the second distance between the longitudinal axis and the automatic coupling device, the plan path comprising:

an inlet portion delimited upstream by the automatic uncoupling device and for a deceleration of the transportation unit, an unloading/loading portion following the inlet portion and for a constant movement of the transportation unit at a designated speed from an entry of the unloading/loading portion to an exit of the unloading/loading portion, the unloading/loading portion comprising a passenger platform and at least a curved portion wherein the enlarged portion extends to at least a part of the curved portion of the unloading/loading portion, and an outlet portion following the unloading/loading portion and for an acceleration of the transportation unit, the outlet portion being delimited downstream by the automatic coupling device, wherein the enlarged portion extends from the unloading/loading portion to at least a part of at least one of the inlet portion and the outlet portion, and the enlarged portion extends to the entire length of at least one of the inlet portion and the outlet portion.

2. The cable transportation system station of claim 1, wherein the enlarged portion of one of the inlet portion and the outlet portion is curvilinear.

3. The cable transportation system station of claim 2, wherein a remaining part of the one of the inlet portion and the outlet portion is rectilinear and parallel to the longitudinal axis.

4. The cable transportation system station of claim 3, wherein the unloading/loading portion comprises at least a rectilinear portion and a curved portion.

5. The cable transportation system station of claim 1, wherein the guiding device identifies a plan path symmetrical with respect to the longitudinal axis.

6. The cable transportation system station of claim 1, wherein at least one of the inlet portion and the outlet portion is rectilinear.

7. A cable transportation system comprising:

a transportation unit; and a station comprising:

an automatic uncoupling device configured to automatically uncouple a cable from the transportation unit;

an automatic coupling device configured to automatically couple the cable to the transportation unit; and a guiding device extending along a longitudinal axis that passes through a first point of medium distance between the automatic uncoupling device and the automatic coupling device and a second point of maximum depth of the guiding device in the cable transportation system station, wherein:

the guiding device is configured to support and guide the transportation unit inside the cable transportation system station between the automatic uncoupling device and the automatic coupling device, a first distance between the longitudinal axis and the automatic uncoupling device and a second distance between the longitudinal axis and the automatic coupling device simultaneously enables an access and an exit of the cable transportation system station, and the guiding device extends along a plan path comprising at least a laterally enlarged portion which is more distant from the longitudinal axis than at least one of the first distance between the longitudinal axis and the automatic uncoupling device and the second distance between the longitudinal axis and the automatic coupling device, the plan path comprising:

an inlet portion delimited upstream by the automatic uncoupling device and for a deceleration of the transportation unit, an unloading/loading portion following the inlet portion and for a constant movement of the transportation unit at a designated speed from an entry of the unloading/loading portion to an exit of the unloading/loading portion, the unloading/loading portion comprising a passenger platform and at least a curved portion wherein the enlarged portion extends to at least a part of the curved portion of the unloading/loading portion, and an outlet portion following the unloading/loading portion and for an acceleration of the transportation unit, the outlet portion being delimited downstream by the automatic coupling device, wherein the enlarged portion of the guiding device of the station extends from the unloading/loading portion to at least a part of at least one of the inlet portion and the outlet portion, and the enlarged portion of the guiding device of the station extends to the entire length of at least one of the inlet portion and the outlet portion.

8. The cable transportation system of claim 7, wherein at least one of the inlet portion and the outlet portion is rectilinear.

* * * * *